US010602860B2

(12) United States Patent
Clark et al.

(10) Patent No.: US 10,602,860 B2
(45) Date of Patent: Mar. 31, 2020

(54) COLLAPSIBLE DISPLAY UNIT

(71) Applicant: Target Brands, Inc., Minneapolis, MN (US)

(72) Inventors: Jeremy A. Clark, Minneapolis, MN (US); Erin L. Zobel, Minneapolis, MN (US); David H. Cheney, New Brighton, MN (US)

(73) Assignee: Target Brands, Inc.

( * ) Notice: Subject to any disclaimer, the term of this patent is extended or adjusted under 35 U.S.C. 154(b) by 40 days.

(21) Appl. No.: 15/617,174

(22) Filed: Jun. 8, 2017

(65) Prior Publication Data

US 2018/0354681 A1 Dec. 13, 2018

(51) Int. Cl.
*A47F 5/11* (2006.01)
*B65D 6/18* (2006.01)

(52) U.S. Cl.
CPC ..... *A47F 5/114* (2013.01); *B65D 11/1853* (2013.01)

(58) Field of Classification Search
CPC ..... B65D 5/6655; B65D 21/086; B65D 5/36
USPC ..... 229/117.05
See application file for complete search history.

(56) References Cited

U.S. PATENT DOCUMENTS 70,598 A 11/1867 Morgan
466,032 A 12/1891 Fleming
589,208 A 8/1897 Gareis
616,848 A 12/1898 Kingsley
632,451 A 9/1899 Drawbaugh
756,311 A 4/1904 Adams
1,838,191 A * 12/1931 Rumpel ..... B65D 5/26 229/117.03
2,331,582 A * 10/1943 Trost ..... B65D 5/3685 229/117
2,354,370 A 7/1944 Gilbert
2,430,755 A * 11/1947 Bergstein ..... B65D 5/3685 493/309
2,593,773 A 4/1952 Levkoff
2,634,900 A 4/1953 Levkoff
3,270,939 A * 9/1966 Ebelhardt ..... B65D 5/3685 229/116.1
3,376,994 A 4/1968 Flinn, Jr.
3,702,675 A 11/1972 Bajo
3,933,301 A * 1/1976 Pugsley ..... B65D 5/3685 229/117.05
3,945,561 A 5/1976 Strebelle
4,094,458 A 6/1978 Nelson, Jr.
4,129,248 A 12/1978 Casutt
(Continued)

*Primary Examiner* — Derek J Battisti
(74) *Attorney, Agent, or Firm* — Leanne Taveggia Farrell; Westman, Champlin & Koehler, P.A.

(57) ABSTRACT

A collapsible display unit includes a first tab protruding from a free edge of a first widthwise sidewall that is insertable into a slot in a base panel. A second tab protrudes from a free edge of an opposing second widthwise sidewall that is insertable into a slot in the base panel. A hinge in the base panel extends lengthwise between two free edges and through a center of the base panel. A hinge in the first widthwise sidewall extends between two free edges and through a center of the first widthwise sidewall. A hinge in the second widthwise sidewall extends between two free edges and through a center of the second widthwise sidewall. The first lengthwise sidewall has opposing end flaps that remain affixed to portions of the widthwise sidewalls for configuration between assembled and collapsed configurations.

18 Claims, 11 Drawing Sheets

(56) References Cited

U.S. PATENT DOCUMENTS

| | | | | |
|---|---|---|---|---|
| 4,428,525 | A * | 1/1984 | Brauner | B65D 5/66 229/112 |
| 5,299,704 | A | 4/1994 | Thorby | |
| 5,398,868 | A * | 3/1995 | Densen | B65D 5/22 229/125.08 |
| 5,474,230 | A | 12/1995 | Yotukura | |
| 5,725,310 | A | 3/1998 | Kruczko | |
| 5,735,423 | A | 4/1998 | Black | |
| 6,032,815 | A | 3/2000 | Elstone | |
| 6,112,928 | A | 9/2000 | Black et al. | |
| 7,083,061 | B2 | 8/2006 | Spindel et al. | |
| 7,143,932 | B2 * | 12/2006 | Wang | A45C 7/0036 229/117.35 |
| 7,431,172 | B1 | 10/2008 | Spindel et al. | |
| 7,597,207 | B2 * | 10/2009 | Green | B60R 7/02 220/4.29 |
| 7,721,941 | B2 | 5/2010 | Kleiner | |
| 7,870,995 | B1 * | 1/2011 | Kaltman | B65D 5/2047 206/485 |
| 8,608,050 | B2 * | 12/2013 | Seliger | B65D 5/2009 229/117.16 |
| 8,985,432 | B2 * | 3/2015 | Cullen | B65D 11/1853 206/170 |
| 2004/0164132 | A1 * | 8/2004 | Kuester | B65D 1/225 229/117.06 |

* cited by examiner

COLLAPSIBLE DISPLAY UNIT

BACKGROUND

Retail stores use a variety of display fixtures to present products to customers for purchase. These display fixtures can support the product, indicate the product price, include signage for highlighting the product and/or include structures that hold samples of the product. Exemplary display structures include shelves, trays, racks, peg hooks, bins and other similar structures.

The discussion above is merely provided for general background information and is not intended to be used as an aid in determining the scope of the claimed subject matter.

SUMMARY

A collapsible display unit includes a base panel having a hinge that extends lengthwise through a center of the base panel. A first slot is located adjacent to but not intersecting with a first widthwise end and centered on the hinge. A second slot is located adjacent to but not intersecting with a second widthwise end and centered on the hinge. A first lengthwise side panel is directly connected lengthwise to the base panel and has first and second opposing end flaps. A second opposing lengthwise side panel is directly connected lengthwise to the base panel. A first widthwise side panel is directly connected to an end of the second lengthwise side panel and includes a portion that is affixed to the first end flap of the first lengthwise side panel. A hinge extends through a center of the first widthwise side panel and is oriented substantially perpendicular to the hinge in the base panel. A first tab protrudes from the first widthwise side panel. A second opposing widthwise side panel is directly connected to an opposing end of the second lengthwise side panel and includes a portion that is affixed to the other of the opposing end flaps of the first lengthwise side panel. A hinge extends through a center of the second widthwise side panel and is oriented substantially perpendicular to the hinge in the base panel. A second tab protrudes from the second widthwise side panel.

A collapsible display unit includes an assembled display configuration and a collapsed configuration. The collapsible display unit includes opposing widthwise sidewalls that each have a centrally located hinge that extends from a first free edge to a second free edge and a protruding tab that protrudes from the second free edge. A base panel has a hinge that extends lengthwise from a first free edge of the base panel to a second free edge of the base panel and through a center of the base panel. A first slot is located adjacent to but not intersecting the first free edge of the base panel and a second slot is located adjacent to but not intersecting the second free edge of the base panel. Opposing lengthwise sidewalls are directly connected lengthwise to the base panel and one of the lengthwise sidewalls includes opposing end flaps. The opposing end flaps are affixed to portions of the opposing widthwise sidewalls that are directly connected to the other of the opposing lengthwise sidewalls. In the assembled display configuration, each protruding tab of the opposing widthwise sidewalls is inserted into one of the respective first and second slots of the base panel so that the second free edges of the opposing widthwise sidewalls are securely positioned adjacent the respective first and second free edges of the base panel. In the collapsed configuration, the protruding tabs of the opposing widthwise sidewalls are free from the respective first and second slots of the base panel and the opposing widthwise sidewalls and the base panel are folded at the hinges without detaching the portions of the opposing widthwise sidewalls from the end flaps of the opposing lengthwise sidewall.

A method of collapsing a display unit for storage includes removing a first tab protruding from a first free edge of a first widthwise sidewall from a first slot in a base panel. A second tab protruding from a first free edge of an opposing second widthwise sidewall is removed from a second slot in the base panel. The display unit is folded along a hinge in the base panel that extends lengthwise from a first free edge of the base panel to a second free edge of the base panel and through a center of the base panel. The display unit is further folded along a hinge in the first widthwise sidewall that extends from the first free edge of the first widthwise sidewall to a second free edge of the first widthwise sidewall and through a center of the first widthwise sidewall and along a hinge in the second widthwise sidewall that extends from the first free edge of the second widthwise sidewall to a second free edge of the second widthwise sidewall and through a center of the second widthwise sidewall. First and second opposing lengthwise sidewalls are directly connected lengthwise to the base panel where the first lengthwise sidewall has opposing end flaps that remain affixed to portions of the opposing widthwise sidewalls for configuration between assembled and collapsed configurations.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Collapsible display units described herein are made of rugged material for continued, permanent use in a retail store. For example, the collapsible display units are made of high density polyethylene (HDP). Even though the collapsible display units are made of durable material, the display units are collapsible so as to allow the units to be folded flat, stored and reused for future purposes. For example, the collapsible display units can be used for seasonal product display, then collapsed or flattened for storage and reused for other seasonal display purposes at a future point in time.

Figure 1:
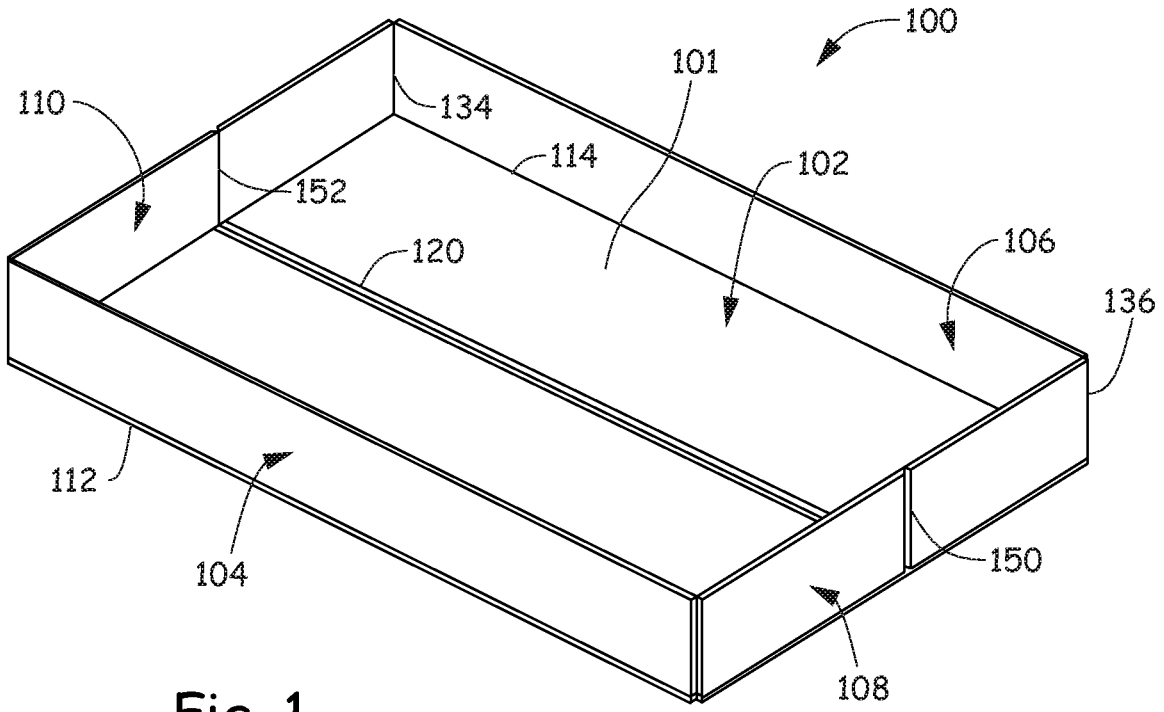
FIG. 1 is a perspective view of a collapsible display unit according to an embodiment.
Figure 2:
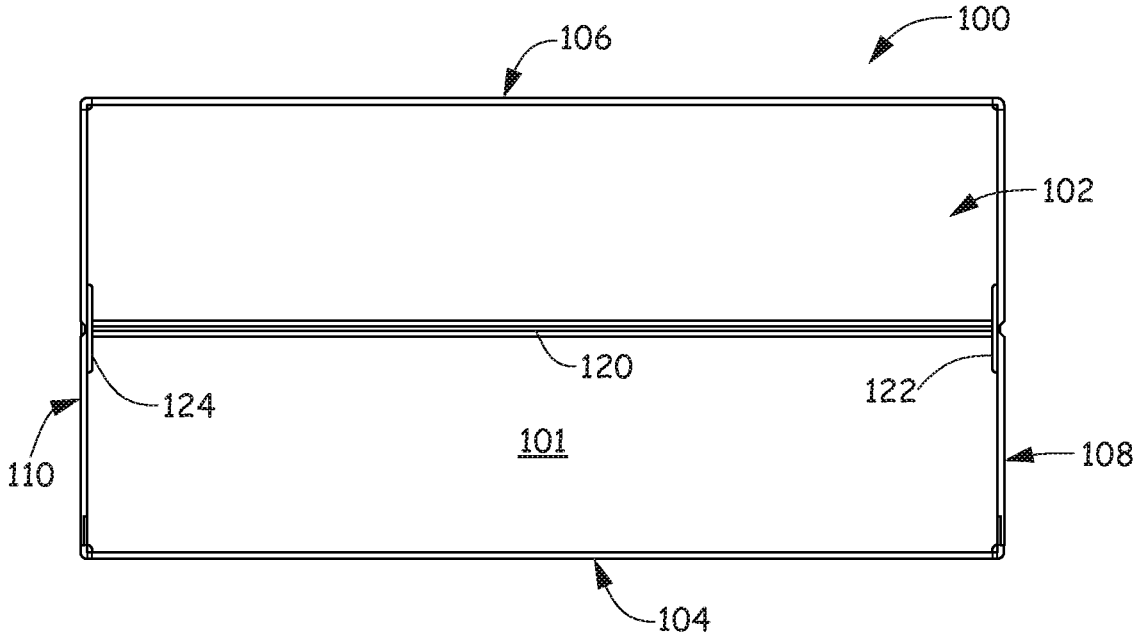
FIG. 2 is a plan view of the collapsible display unit of FIG. 1.
Figure 3:
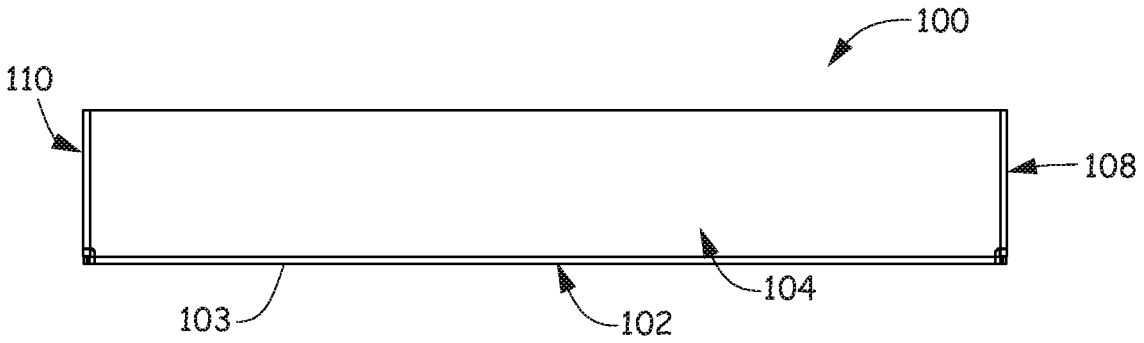
FIG. 3 is a front view of the collapsible display unit of FIG. 1.
Figure 4:
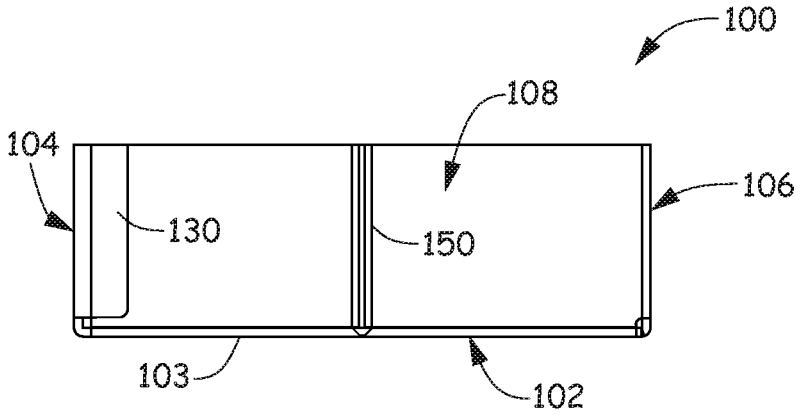
FIG. 4 a side view of the collapsible display unit of FIG. 1.

FIG. 1 is a perspective view of a collapsible display unit 100 according to an embodiment. In particular, FIG. 1 is a top perspective view of collapsible display unit 100 in what would be an assembled bin configuration and also a bottom perspective view of collapsible display unit 100 in what would be an assembled riser configuration. FIG. 2 is a plan view of display unit 100. In particular, FIG. 2 is a top plan view of collapsible display unit 100 in what would be an assembled bin configuration and also a bottom plan view of collapsible display unit 100 in what would be an assembled riser configuration. FIG. 3 is a front view of collapsible display unit 100. FIG. 4 is a side view of collapsible display unit 100. Collapsible display unit 100 includes a base panel 102, a first lengthwise sidewall or side panel 104, a second lengthwise side wall or side panel 106, a first widthwise sidewall or side panel 108 and a second widthwise sidewall or side panel 110.

Collapsible display unit 100 can be oriented as illustrated in FIG. 1 to function as a bin for displaying products for sale. When collapsible display unit 100 is operating in the bin configuration, an interior surface 101 of base panel 102 of bin 100 faces upwardly and supports products for sale and an exterior surface 103 of base panel 102 faces downwardly. In the alternative, collapsible display unit 100 can be oriented upside down relative to how collapsible display unit 100 is illustrated in FIG. 1 to function as a riser. When collapsible display unit 100 is operating in the riser configuration, exterior surface 103 of base panel 102 faces upwardly and supports products for sale or other display units and interior surface 101 of base panel 102 faces downwardly.

Figure 5:
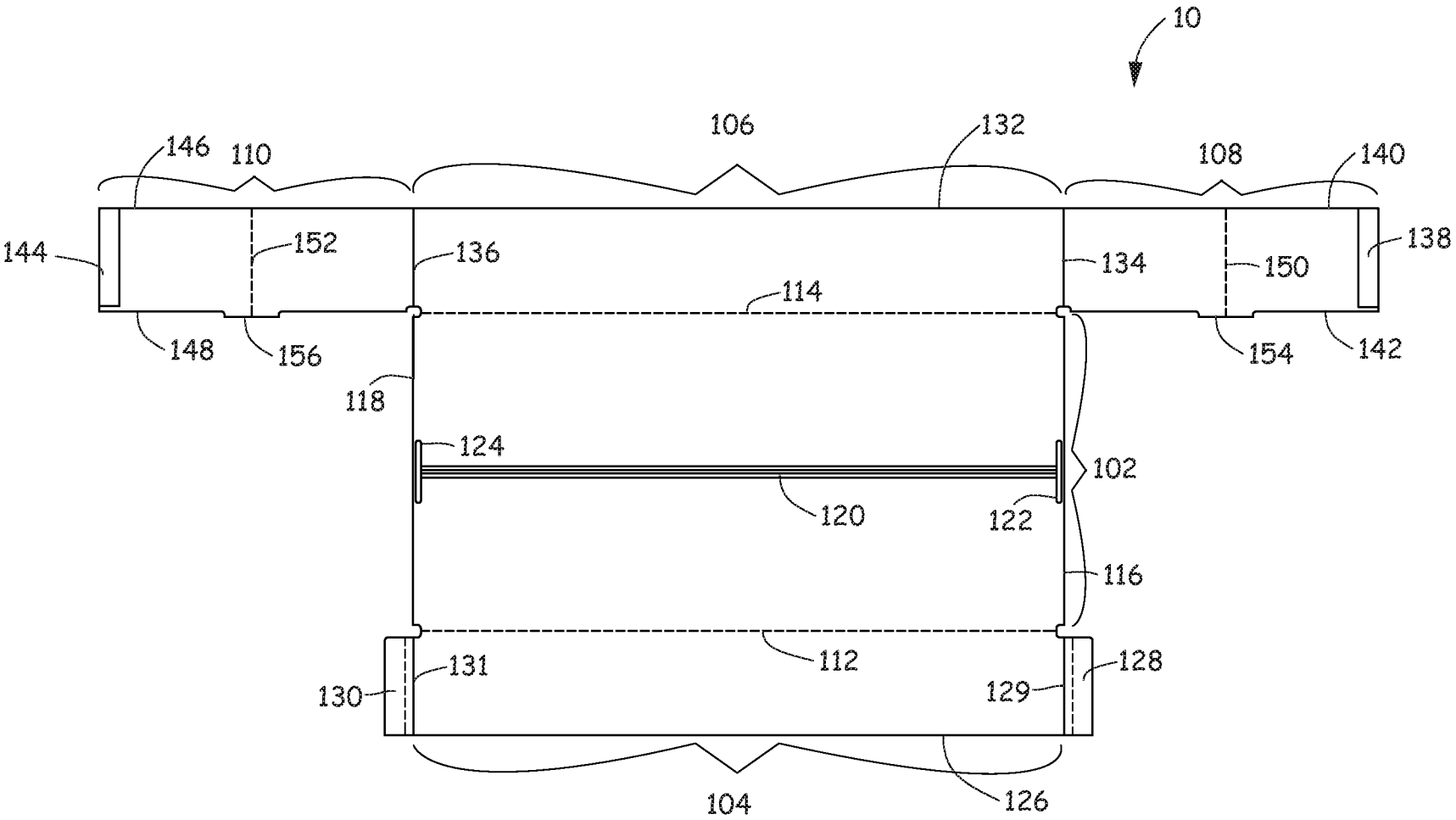
FIG. 5 is a plan view of sheet material formable into the collapsible display unit of FIGS. 1-4.

FIG. 5 is a plan view of sheet material 10 formable into assembled collapsible display unit 100. For example, sheet material 10 can be made of HDP. As illustrated in FIG. 5, sheet material 10 includes base panel 102 defined by opposing lengthwise bend lines 112 and 114 and widthwise free edges 116 and 118. Base panel 102 includes a lengthwise hinge 120 that extends from widthwise free edge 116 to widthwise free edge 118 and is located along a line that runs lengthwise down the center of base panel 102. In one embodiment, lengthwise bend lines 112 and 114 and lengthwise hinge 120 are living hinges. In other words, the material at bend lines 112 and 114 and at lengthwise hinge 120 is thinned, cut or grooved out, for example on the opposing side, to allow the rigid pieces to bend along the line of the bend or hinge. Base panel 102 also includes two slots 122 and 124. First slot 122 runs substantially parallel to widthwise free edge 116, is located adjacent to but not intersecting with widthwise free edge 116, and is centered across lengthwise hinge 120. Likewise, second slot 124 runs substantially parallel to widthwise free edge 118, is located adjacent to but not intersecting with widthwise free edge 118 and is centered across lengthwise hinge 120.

First lengthwise side panel 104 is directly connected to base panel 102 by first lengthwise bend line 112, and second lengthwise side panel 106 is directly connected to base panel 102 by second lengthwise bend line 114. First lengthwise side panel 104 is defined by first lengthwise bend line 112, lengthwise free edge 126 and includes first and second opposing weld or end flaps 128 and 130, which are defined by bend lines 129 and 131, respectively. Second lengthwise side panel 106 is defined by second lengthwise bend line 114, lengthwise free edge 132 and opposing bend lines 134 and 136. In one embodiment, bend lines 129, 131, 134 and 136 are like bend lines 112 and 114 in that they are living hinges that are thinned, cut or grooved out, for example on the opposing side, to allow the rigid pieces to bend along the bend lines.

First widthwise side panel 108 is directly connected to an end of second lengthwise panel 106 by first bend line 134, and second widthwise side panel 110 is directly connected to second lengthwise panel 106 by opposing second bend line 136. First widthwise side panel 108 is defined by first bend line 134, a weld area 138 that opposes first bend line 134, a widthwise top free edge 140 and a widthwise bottom free edge 142. Second widthwise side panel 110 is defined by second bend line 136, a weld area 144 that opposes bend line 136, a widthwise top free edge 146 and a widthwise bottom free edge 148.

Each of first and second widthwise side panels 108 and 110 includes a respective hinge 150 and 152. In one embodiment, hinges 150 and 152 are like hinge 120 in that they are living hinges that are thinned, cut or grooved out, for example on the opposing side, to allow the rigid pieces to bend along the line of the hinge. Hinge 150 of first widthwise side panel 108 extends from widthwise top free edge 140 to widthwise bottom free edge 142 and is located along a line that runs the height of and down the center of first widthwise side panel 108. In other words, hinge 150 is oriented substantially perpendicular to hinge 120 in base panel 102. Hinge 152 of second widthwise side panel 110 extends from widthwise top free edge 146 to widthwise bottom free edge 148 and is located along a line that runs the height of and down the center of second widthwise side panel 110. In other words, hinge 152 is oriented substantially perpendicular to hinge 120 in base panel 102. First and second side panels 108 and 110 also include a respective first tab 154 and second tab 156. First tab 154 protrudes from widthwise bottom free edge 142 of first widthwise side panel 108 and is centered across hinge 150. Second tab 156 protrudes from widthwise bottom free edge 148 of second widthwise side panel 110 and is centered across hinge 152.

Sheet material 10 is formed into the assembled configuration of display unit 100 as illustrated in FIGS. 1-4. In particular, sheet material 10 is folded up at lengthwise bend lines 112 and 114. Weld or end flaps 128 and 130 are folded at respective bend lines 129 and 131. Sheet material 10 is also folded at bend lines 134 and 136. Upon sheet material 10 being bent at bend lines 112, 114, 129, 131 and 134 and 136, weld area or portion 138 of first widthwise side panel 108 is welded to first end flap 128 and weld area or portion 144 of second widthwise side panel 110 is welded to second end flap 130. It should be realized that other ways of affixing these areas together are possible, for example, by adhesive, however, affixing by welding makes for a strong, permanent and unbroken connection. After affixing portions 138 and 144 to end flaps 128 and 130, the assembled display configuration includes first tab 154 and second tab 156 being inserted into respective first slot 122 and second slot 124 so that first and second lengthwise panels 104 and 106 are substantially perpendicular to base panel 102. In addition, bottom free edge 142 of first widthwise side panel 108 is then adjacent to widthwise free edge 116, first widthwise side panel 108 is then located substantially perpendicular to base panel 102, bottom free edge 148 of second widthwise side panel 110 is then adjacent to widthwise free edge 118 and widthwise second side panel 110 is then located substantially perpendicular to base panel 102. In the assembled display configuration, hinge 120 in base panel 102 and hinges 150 and 152 in first and second widthwise side panels 108 and 110 are flattened or unbent.

Figure 6:
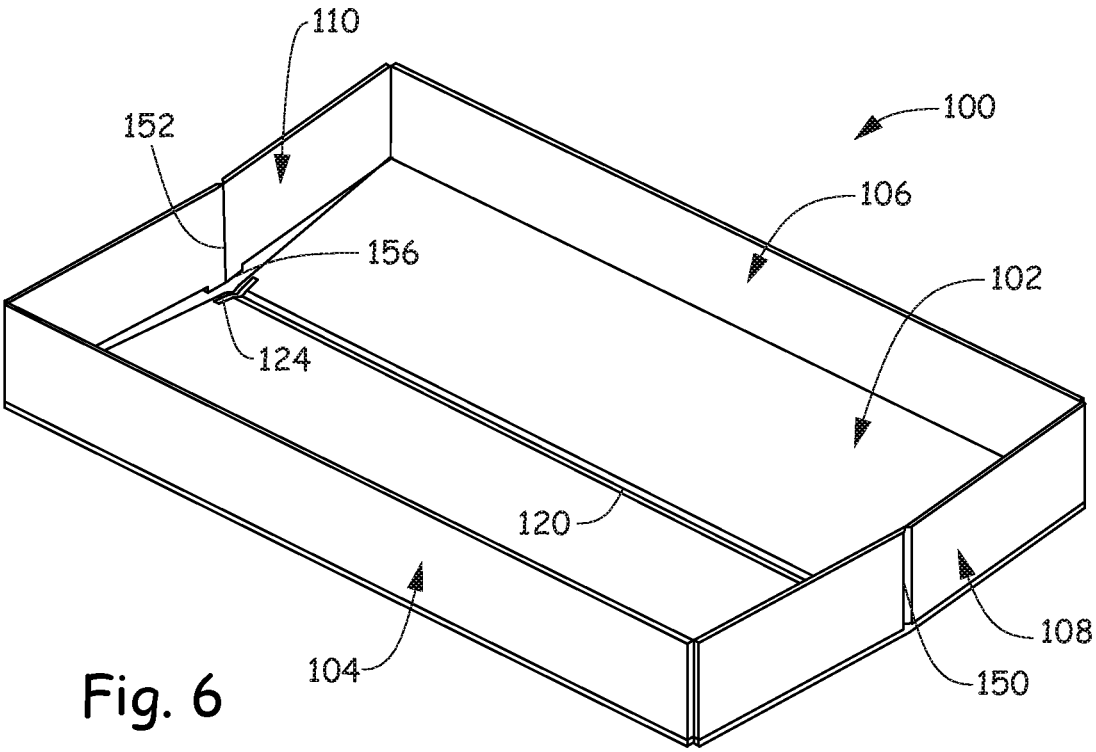
FIG. 6 is a perspective view of the collapsible display unit in FIGS. 1-4 in a first step of being collapsed according to an embodiment.
Figure 7:
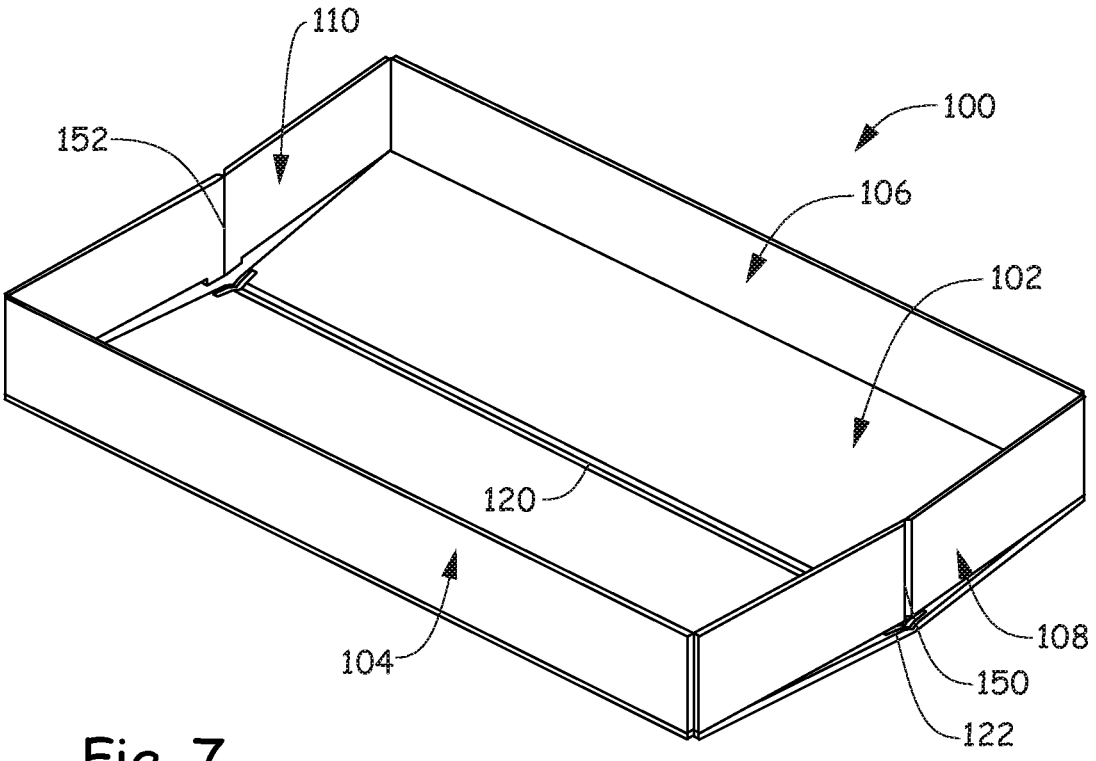
FIG. 7 is a perspective view of the collapsible display unit in FIGS. 1-4 in an intermediate step of being collapsed according to an embodiment.
Figure 8:
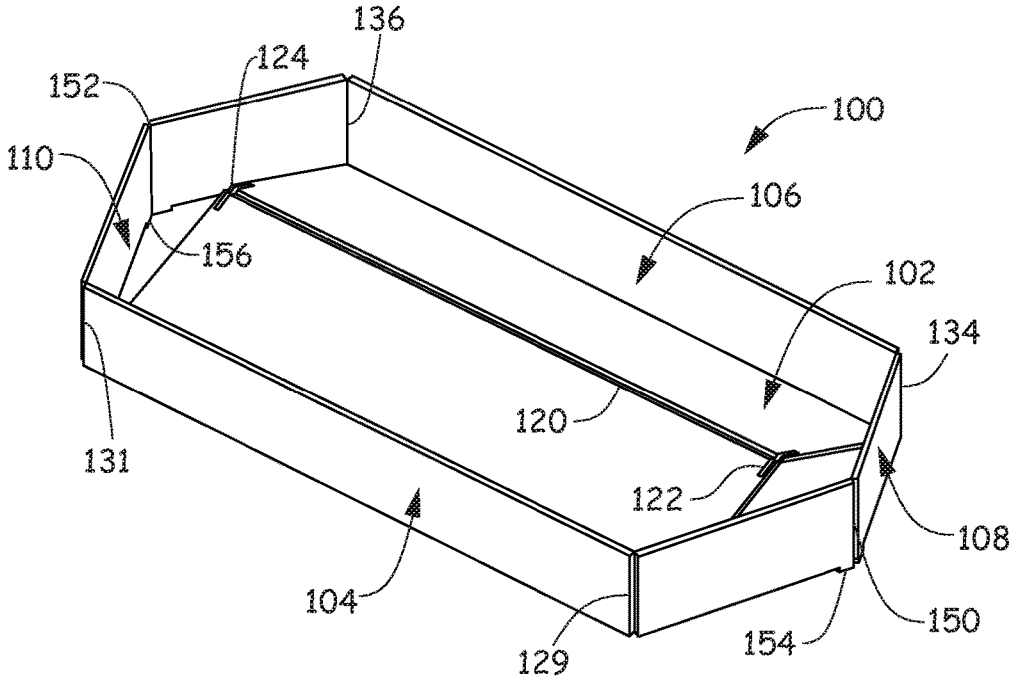
FIG. 8 is a perspective view of the collapsible display unit of FIGS. 1-4 in an intermediate step of being collapsed according to an embodiment.
Figure 9:
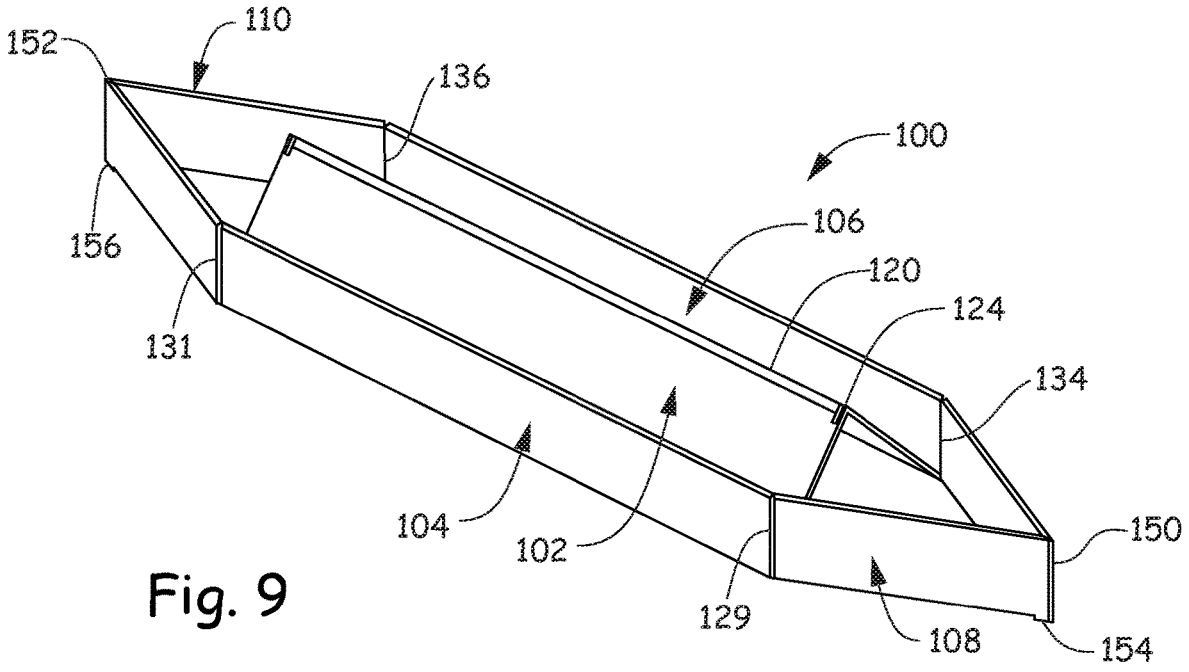
FIG. 9 is a perspective view of the collapsible display unit of FIGS. 1-4 in a collapsed state according an embodiment.

From the assembled display configuration of display unit 100 shown in FIGS. 1-4, display unit 100 can be collapsed, as shown in FIGS. 6-9, without breaking the permanent connection between weld areas or portions 138 and 144 and respective weld or end flaps 128 and 130. In FIG. 6, one of the tabs of one of the widthwise sidewalls, such as second tab 156 of second widthwise sidewall 110, is removed from the corresponding slot, such as second slot 124 in base panel 102, by pulling the widthwise sidewall, such as widthwise sidewall 110, up. Such a maneuver is possible given hinge 152 in second widthwise sidewall 110. In FIG. 7, the other of the tabs of the other of the widthwise sidewalls, such as first tab 154 of first widthwise sidewall 108, is removed from the corresponding slot, such as first slot 122 in base panel 102, by pulling the widthwise sidewall, such as first widthwise sidewall 108, up. This maneuver is possible given hinge 150 in first widthwise sidewall 108. As illustrated in FIG. 8, base panel 102 is bent upwardly along hinge 120 to fold base panel 102 into a folded state. While hinge 120 is bending, hinge 150 in first widthwise side panel 108 and hinge 152 in second widthwise side panel 110 are also bending the respective side panels into folded states, which results in bends along bend lines 129, 131, 134 and 136 becoming at least partially flattened or unbent. FIG. 9 illustrates an almost completed collapsed state of display unit 100. In the collapsed state, lengthwise panel 104 is located adjacent to folded base panel 102, which is located adjacent to lengthwise panel 106. Halves of each of first and second widthwise side panels 108 and 110 are folded to be adjacent to each other.

Figure 10:
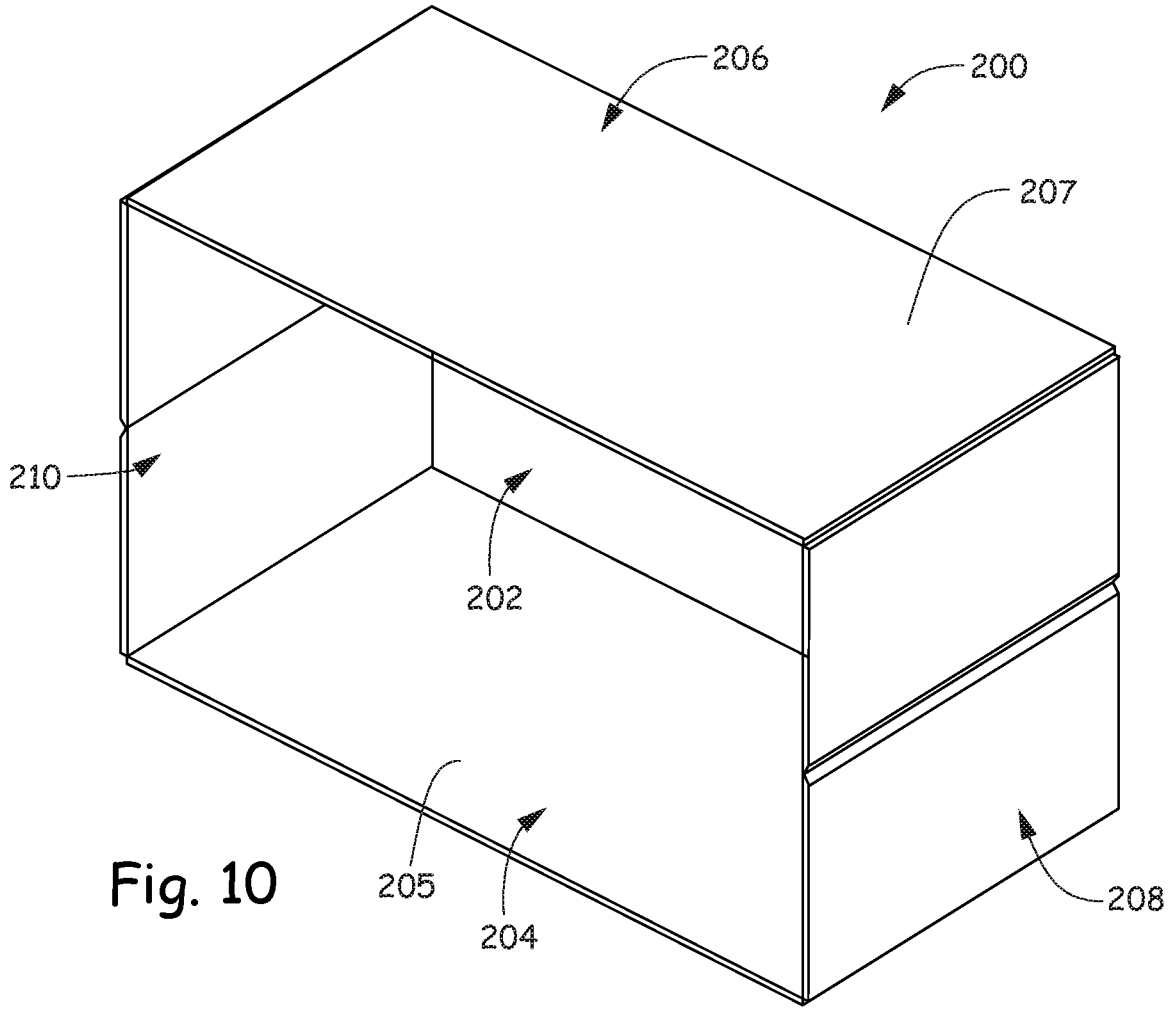
FIG. 10 is a perspective view of a collapsible display unit according to an embodiment.
Figure 11:
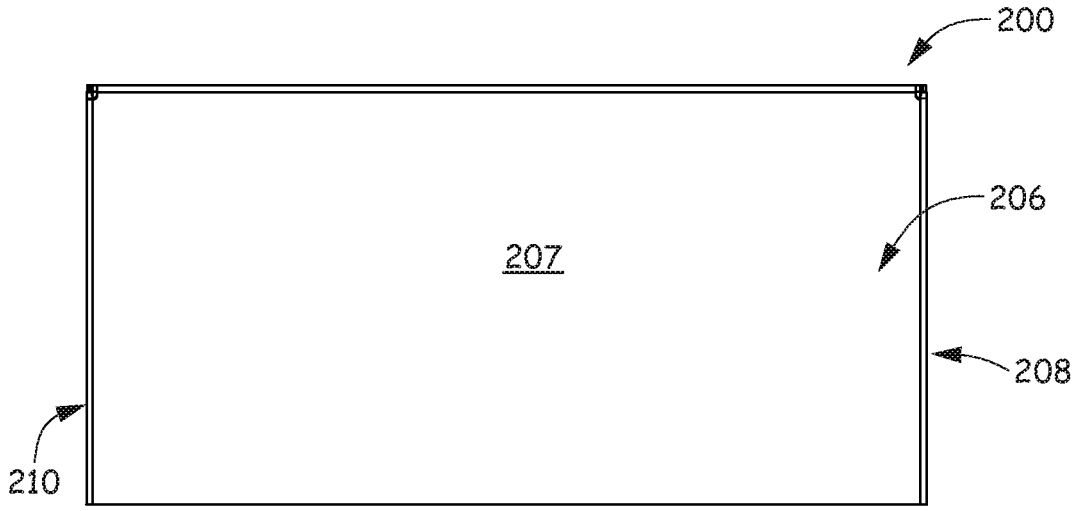
FIG. 11 is a top view of the collapsible display unit of FIG. 10.
Figure 12:
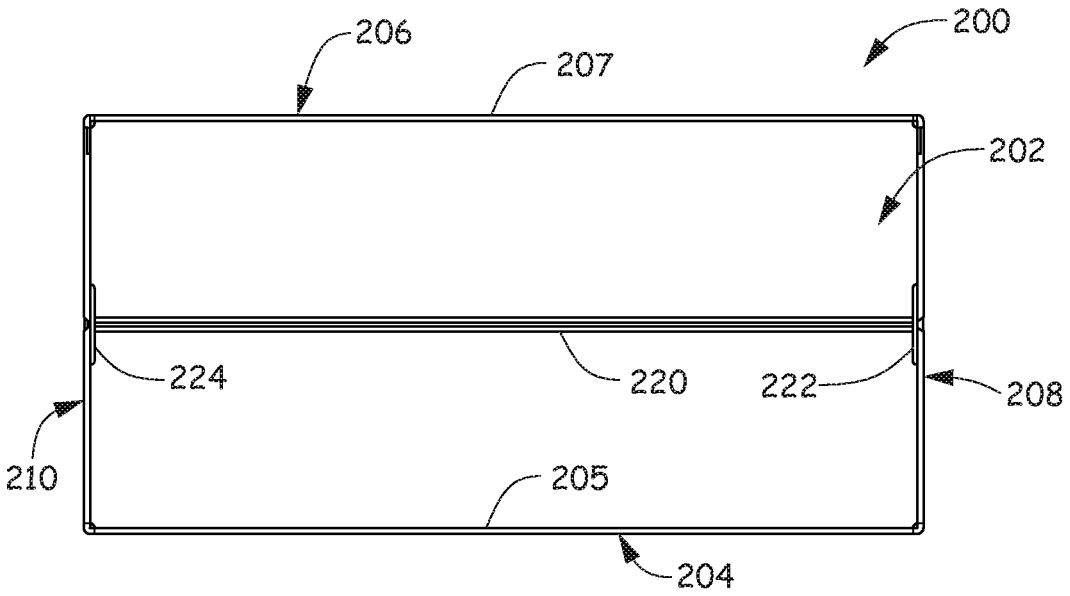
FIG. 12 is a front view of the collapsible display unit of FIG. 10.
Figure 13:
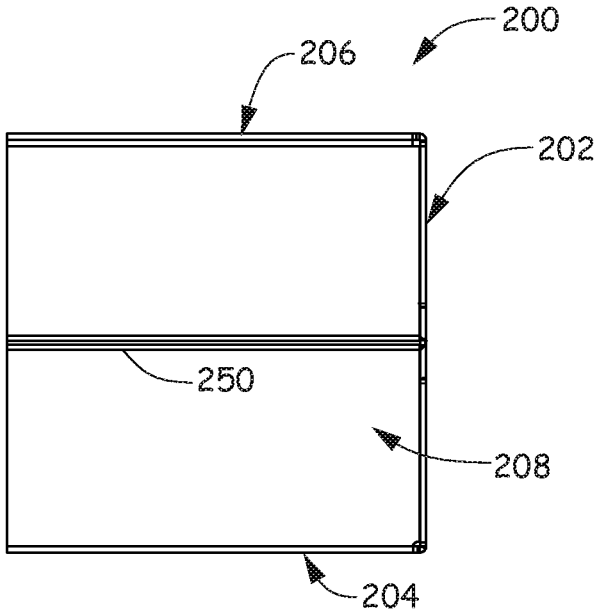
FIG. 13 a side view of the collapsible display unit of FIG. 10.

FIG. 10 is a perspective view of a collapsible display unit 200 according to an embodiment. In particular, FIG. 10 is a top perspective view of collapsible display unit 200 in what would be an assembled riser configuration. FIG. 11 is a top view, FIG. 12 is a front view and FIG. 13 is a side view of collapsible display unit 200. Collapsible display unit 200 includes a base panel 202, a first lengthwise sidewall or side panel 204, a second lengthwise sidewall or side panel 206, a first widthwise sidewall or side panel 208 and a second widthwise sidewall or side panel 210.

Collapsible display unit 200 can be oriented as illustrated in FIG. 10 to function as a riser for displaying products for sale. When collapsible display unit 200 is operating in the riser configuration, an interior surface 205 of first lengthwise panel 204 of bin 100 faces upwardly and supports products for sale and an exterior surface 207 of second lengthwise side panel 206 also faces upwardly and supports products for sale. In the alternative, collapsible display unit 200 can be oriented so an exterior surface of base panel 202 faces upwardly to also function as a riser or display unit 200 can be oriented so an interior surface of base panel 202 faces upwardly to function as a bin.

Figure 14:
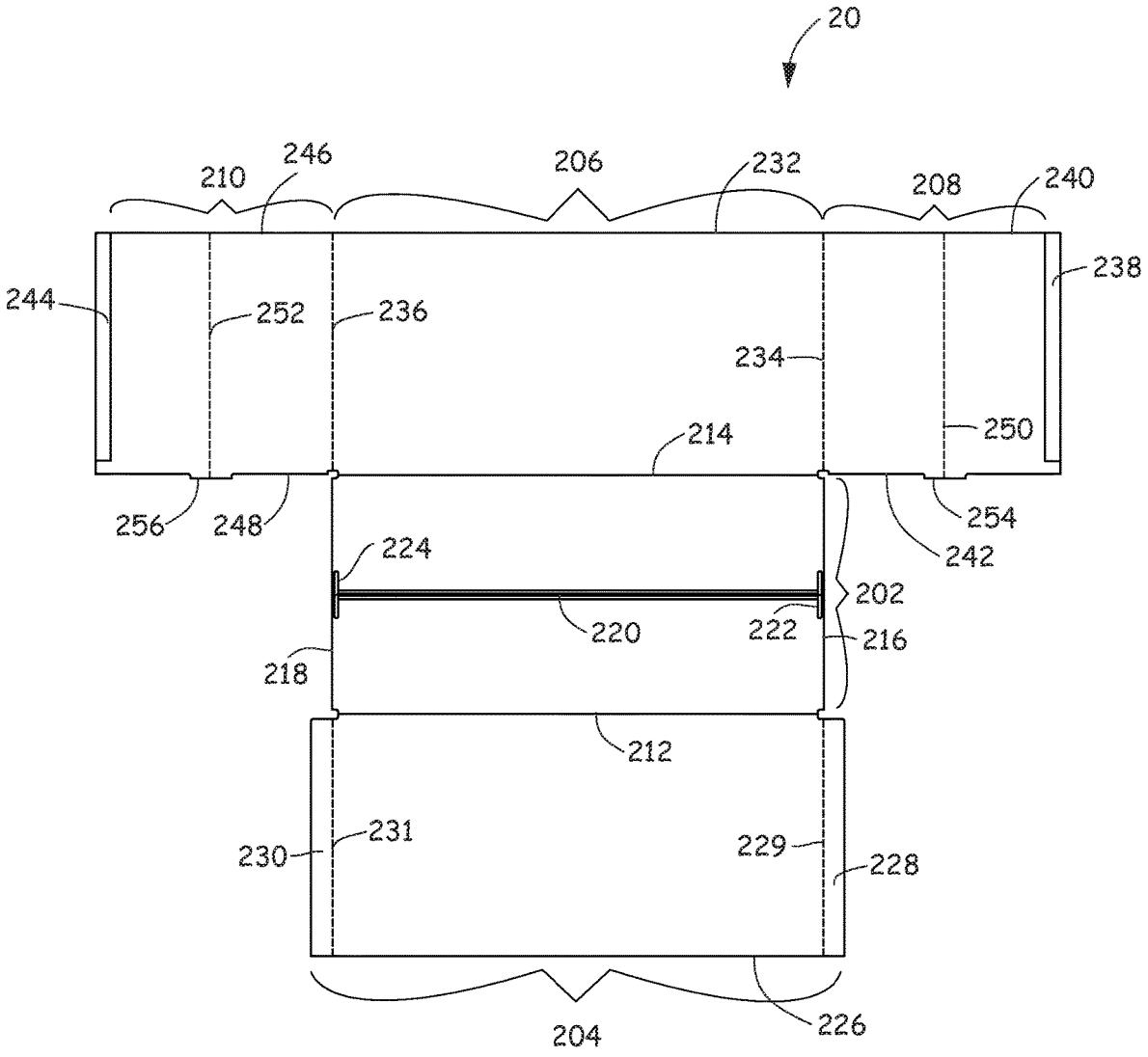
FIG. 14 is a plan view of sheet material formable into the assembled collapsible display unit of FIGS. 10-13.

FIG. 14 is a plan view of sheet material 20 formable into assembled collapsible display unit 200. For example, sheet material 20 can be made of HDP. As illustrated in FIG. 14, sheet material 20 includes base panel 202 defined by opposing lengthwise bend lines 212 and 214 and widthwise free edges 216 and 218. Base panel 202 includes a lengthwise hinge 220 that extends from widthwise free edge 216 to widthwise free edge 218 and is located along a line that runs lengthwise down the center of base panel 202. In one embodiment, lengthwise bend lines 212 and 1214 and lengthwise hinge 220 are living hinges. In other words, the material at bend lines 212 and 214 and at lengthwise hinge 220 is thinned, cut or grooved out, for example on the opposing side, to allow the rigid pieces to bend along the line of the bend or hinge. Base panel 202 also includes two slots 222 and 224. First slot 222 runs substantially parallel to widthwise free edge 216, is located adjacent to but not intersecting with widthwise free edge 216 and is centered across lengthwise hinge 220. Likewise, second slot 224 runs substantially parallel to widthwise free edge 218, is located adjacent to but not intersecting with widthwise free edge 218 and is centered across lengthwise hinge 220.

First lengthwise side panel 204 is directly connected to base panel 202 by first lengthwise bend line 212, and second lengthwise side panel 206 is directly connected to base panel 202 by second lengthwise bend line 214. First lengthwise side panel 204 is defined by first lengthwise bend line 212, lengthwise free edge 226 and includes first and second opposing weld or end flaps 228 and 230, which are defined by bend lines 229 and 231, respectively. Second lengthwise side panel 206 is defined by second lengthwise bend line 214, lengthwise free edge 232 and opposing bend lines 234 and 236. In one embodiment, bend lines 229, 231, 234 and 236 are like bend lines 212 and 214 in that they are living hinges that are thinned, cut or grooved out, for example on the opposing side, to allow the rigid pieces to bend along the bend lines.

First widthwise side panel 208 is directly connected to an end of second lengthwise panel 206 by first bend line 234, and second widthwise side panel 210 is directly connected to second lengthwise panel 206 by opposing second bend line 236. First widthwise side panel 208 is defined by first bend line 234, a weld area or portion 238 that opposes bend line 234, a widthwise top free edge 240 and a widthwise bottom free edge 242. Second widthwise side panel 210 is defined by second bend line 236, a weld area or portion 244 that opposes bend line 236, a widthwise top free edge 246 and a widthwise bottom free edge 248.

Each of first and second widthwise side panels 208 and 210 includes a respective hinge 250 and 252. In one embodiment, hinges 250 and 252 are like hinge 220 in that they are living hinges that are thinned, cut or grooved out, for example on the opposing side, to allow the rigid pieces to bend along the line of the hinge. Hinge 250 of first widthwise side panel 208 extends from widthwise top free edge 240 to widthwise bottom free edge 242 and is located along a line that runs the height of and down the center of first widthwise side panel 208. In other words, hinge 250 is oriented substantially perpendicular to hinge 220 in base panel 202. Hinge 252 of second widthwise side panel 210 extends from widthwise top free edge 246 to widthwise bottom free edge 248 and is located along a line that runs the height of and down the center of second side panel 210. In other words, hinge 252 is oriented substantially perpendicular to hinge 220 in base panel 202. First and second side panels 208 and 210 also include a respective first tab 254 and second tab 256. First tab 254 protrudes from widthwise bottom free edge 242 of first widthwise side panel 208 and is centered across hinge 250. Second tab 256 protrudes from widthwise bottom free edge 248 of second widthwise side panel 210 and is centered on hinge 252.

Sheet material 20 is formed into the assembled configuration of display unit 200 as illustrated in FIGS. 10-13. In particular, sheet material 20 is folded up at lengthwise bend lines 212 and 214. Weld flaps 228 and 230 are folded at respective bend lines 229 and 231. Sheet material 20 is also folded at bend lines 234 and 236. Upon sheet material 20 being bent at bend lines 212, 214, 229, 231 and 234 and 236, weld area or portion 238 of first widthwise side panel 208 is welded to first weld flap 228 and weld area or portion 244 of second widthwise side panel 210 is welded to second weld flap 230. It should be realized that other ways of affixing these areas together are possible, for example, by adhesive, however, affixing by welding makes for a strong, permanent and unbroken connection. After affixing weld areas 238 and 244 to respective weld flaps 228 and 230, the assembled display configuration includes first tab 254 and second tab 256 being inserted into respective first slot 222 and second slot 224 so that first and second lengthwise panels 204 and 206 are substantially perpendicular to base panel 202. In addition, bottom free edge 242 of first widthwise side panel 208 is then adjacent to widthwise free edge 216, first widthwise side panel 208 is then located substantially perpendicular to base panel 202, bottom free edge 248 of second widthwise side panel 210 is then adjacent to widthwise free edge 218 and second widthwise side panel 210 is located substantially perpendicular to base panel 202. In the assembled display configuration, hinge 220 of base panel 202 and hinges 250 and 252 in first and second widthwise side panels 208 and 210 are flattened or unbent.

Figure 15:
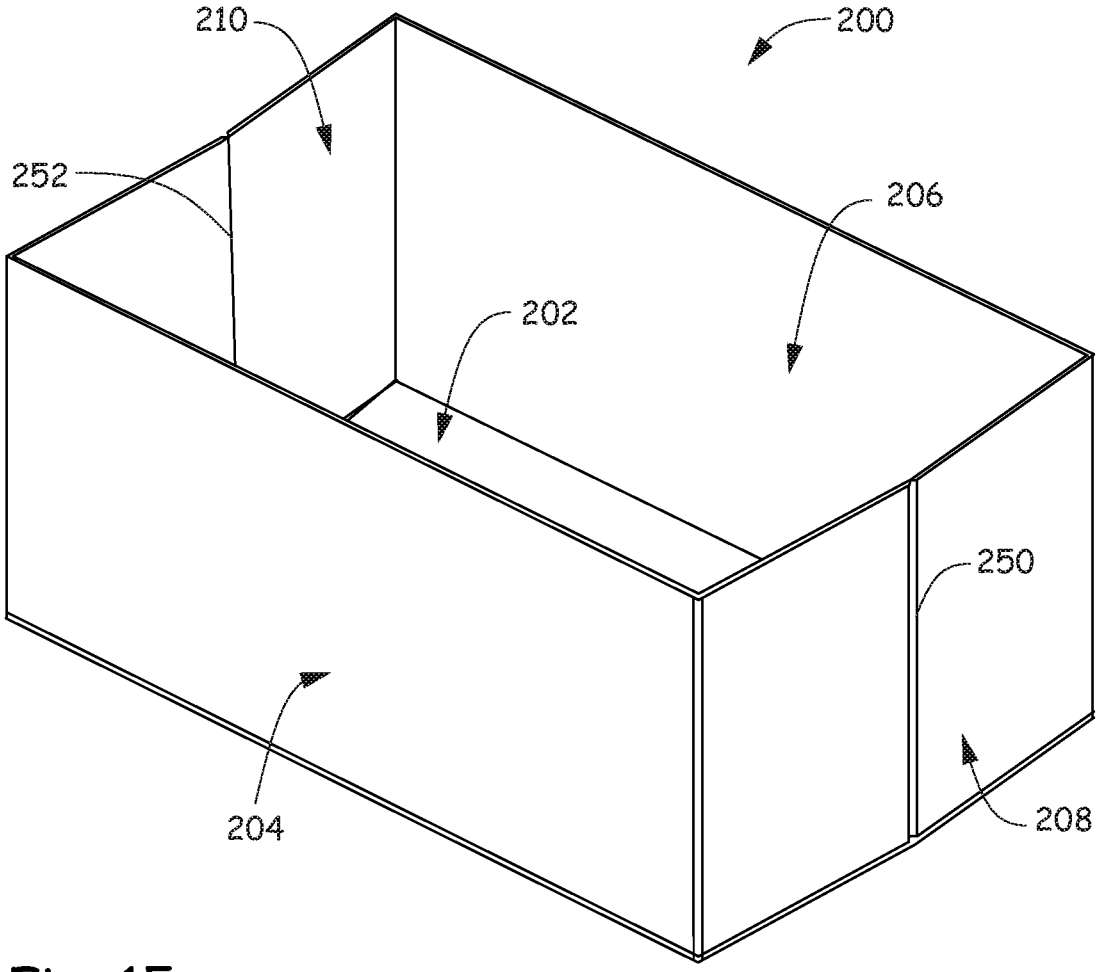
FIG. 15 is a perspective view of the collapsible display bin of FIGS. 10-13 as erected according to an embodiment.
Figure 16:
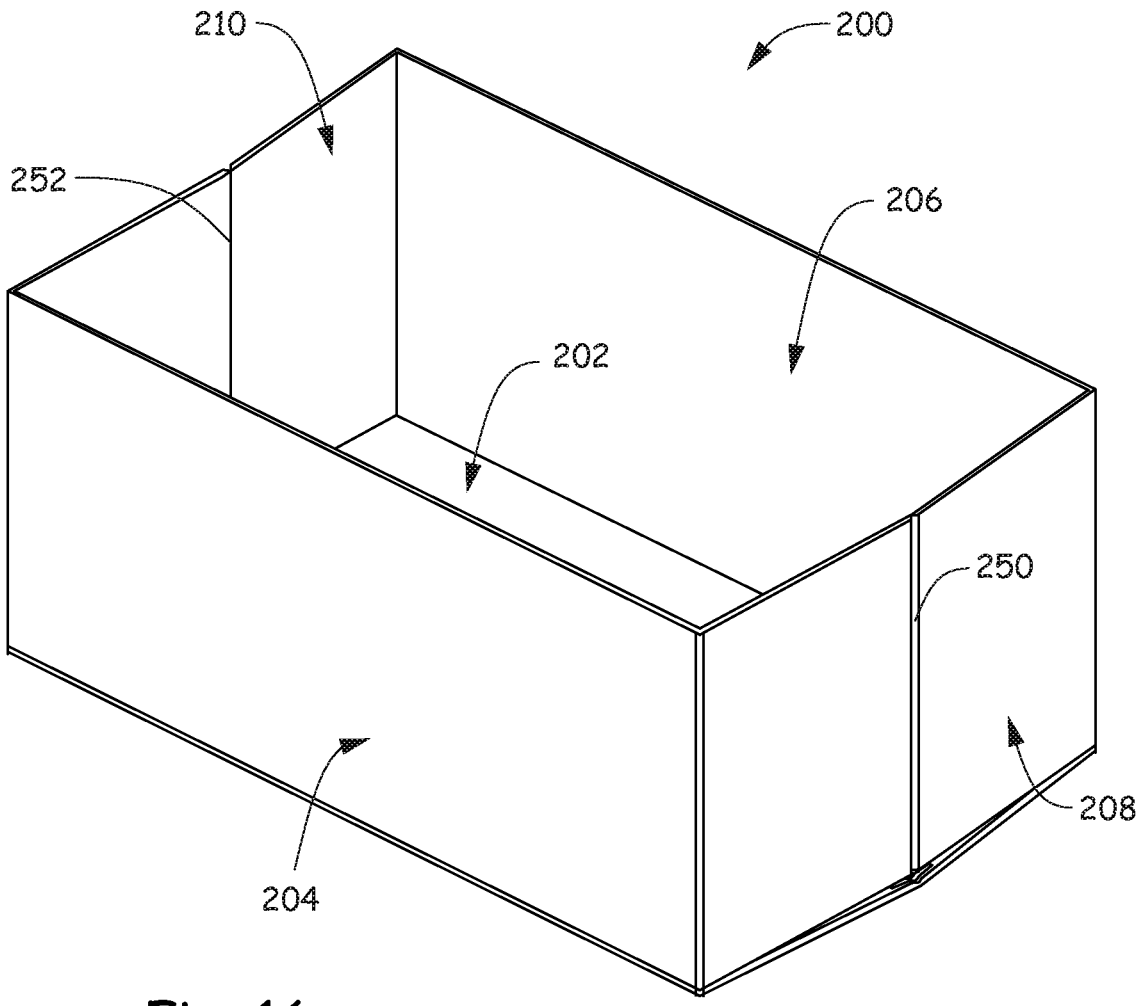
FIG. 16 is a perspective view of the collapsible display bin of FIGS. 10-13 in an intermediate step of being collapsed according to an embodiment.
Figure 17:
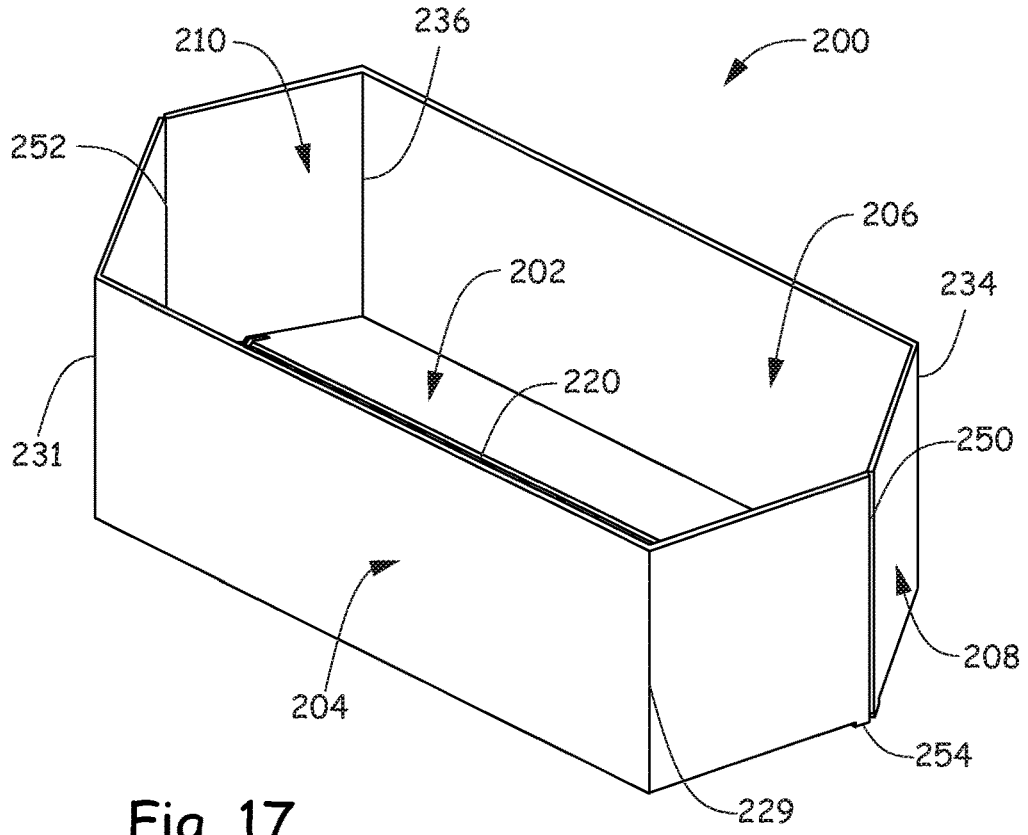
FIG. 17 is a perspective view of the collapsible display bin of FIGS. 10-13 in an intermediate step of being collapsed according to an embodiment.
Figure 18:
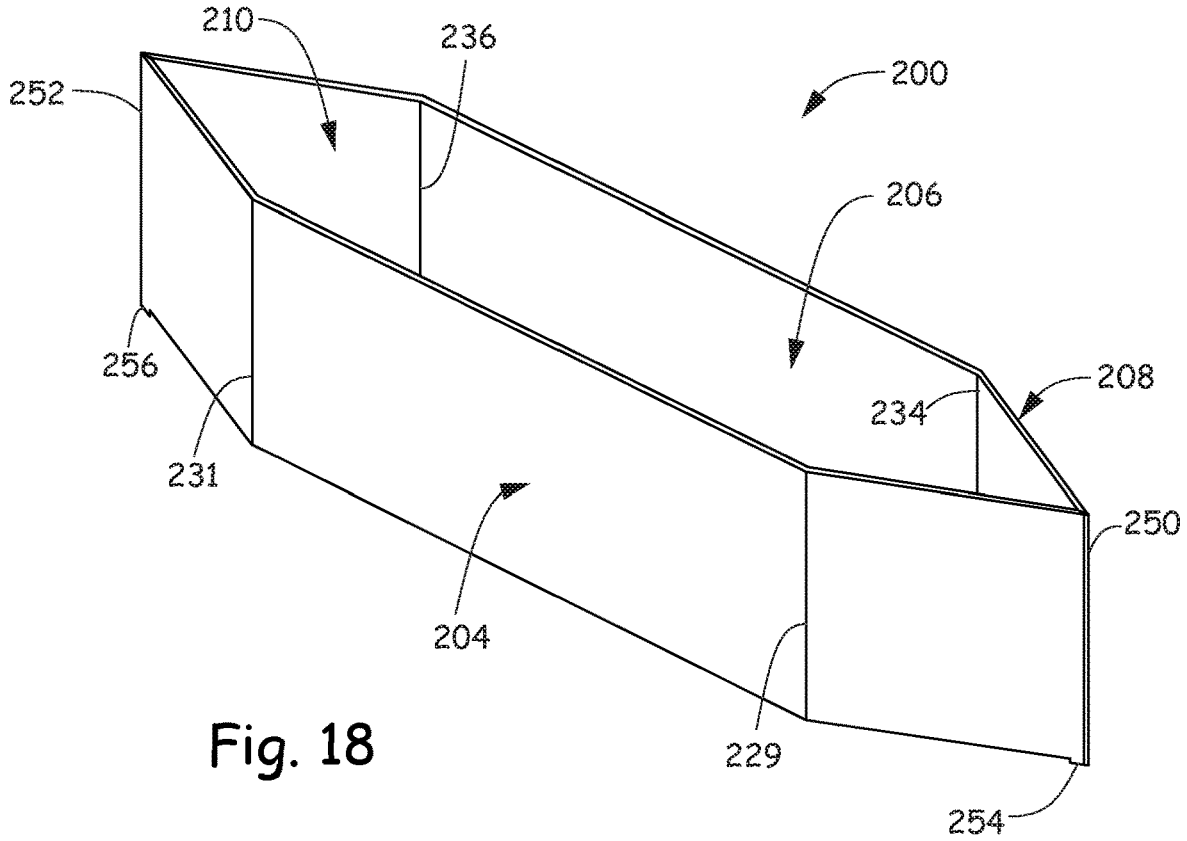
FIG. 18 is a perspective view of the collapsible of display bin of FIGS. 10-13 in a collapsed state according an embodiment.

From the assembled display configuration of display unit 200, display unit 200 can be collapsed, as shown in FIGS. 15-18, without breaking the permanent connection between weld areas 238 and 244 and respective weld flaps 228 and 230. In FIG. 15, one of the tabs of one of the widthwise sidewalls, such as second tab 256 of second widthwise sidewall 210, is removed from the corresponding slot, such as second slot 224 in base panel 202, by pulling the widthwise sidewall, such as widthwise sidewall 210, up. Such a maneuver is possible given hinge 252 in second widthwise sidewall 210. In FIG. 16, the other of the tabs of the other of the widthwise sidewalls, such as first tab 254 of first widthwise sidewall 208, is removed from the corresponding slot, such as first slot 222 in base panel 202, by pulling the widthwise sidewall, such as first widthwise sidewall 208, up. This maneuver is possible given hinge 250 in first widthwise sidewall 208. As illustrated in FIG. 17, base panel 202 is bent upwardly along hinge 220 to fold base panel 202 into a folded state. While hinge 220 is bending, hinge 250 in first widthwise side panel 208 and hinge 252 in second widthwise side panel 210 are also bending the respective widthwise side panels 208 and 210 into folded states, which results in bends along bend lines 229, 231, 234 and 236 becoming at least partially flattened or unbent. FIG. 18 illustrates display unit 200 an almost completed collapsed state. In the collapsed state, lengthwise side panel 204 is located adjacent to folded base panel 202, which is located adjacent to lengthwise side panel 206. Halves of each of first and second widthwise side panels 208 and 210 are folded against each other.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A collapsible display unit comprising:

a high density, rigid sheet material comprising:

a base panel including a first widthwise free edge, an opposing second widthwise free edge and a living hinge that extends lengthwise through a center of the base panel from the first widthwise free edge to the second widthwise free edge, a first slot located adjacent to but not intersecting with the first widthwise free edge and centered on the living hinge and a second slot located adjacent to but not intersecting with the second widthwise free edge and centered on the hinge;

a first lengthwise side panel directly connected lengthwise to the base panel and having opposing first and second end flaps, the first lengthwise side panel having a length that corresponds with a length of the base panel;

an opposing second lengthwise side panel directly connected lengthwise to the base panel, the second lengthwise side panel having a length that corresponds with a length of the base panel;

a first widthwise side panel directly connected to an end of the second lengthwise side panel and including a portion that is welded to the first end flap of the first lengthwise side panel, a living hinge that extends through a center of the first widthwise side panel and is oriented substantially perpendicular to the hinge in the base panel and a first tab that protrudes from the first widthwise side panel, the first widthwise side panel having a width that corresponds with a width of the first widthwise free edge of the base panel; and a second opposing widthwise side panel directly connected to an opposing end of the second lengthwise side panel and including a portion that is welded to the second end flap of the first lengthwise side panel, a living hinge that extends through a center of the second widthwise side panel and is oriented substantially perpendicular to the hinge in the base panel and a second tab that protrudes from the second widthwise side panel, the second widthwise side panel having a width that corresponds with a width of the second widthwise free edge of the base; and wherein in an assembled display configuration the living hinges in the base panel and in the first and second widthwise side panels are unbent and the first tab is securely inserted into the first slot and the second tab is securely inserted in to the second slot.

2. The collapsible display unit of claim 1, wherein the first lengthwise side panel is directly connected to the base panel by a first lengthwise bend line and the second lengthwise side panel is directly connected to the base panel by a second lengthwise bend line.

3. The collapsible display unit of claim 1, wherein the first widthwise side panel is directly connected to the second lengthwise side panel by a first bend line and the second widthwise side panel is directly connected to the second lengthwise side panel by a second bend line.

4. The collapsible display unit of claim 1, wherein the living hinge in the base panel and the living hinges in the first and second widthwise side panels are bent in a collapsed configuration so that an inside of two portions of the first widthwise side panel and an inside of two portions of the second widthwise side panel are positioned flat against each other, remain welded to the respective first end flap and second end flap of the first lengthwise side panel and are positioned away from the base panel, and wherein an outside of two portions of the base panel defined by the living hinge of the base panel folds flat against each other such that a thickest portion of the collapsed display unit includes the first and second lengthwise side panels and the two portions of the base panel that all fold flat against each other.

5. The collapsible display unit of claim 1, wherein an interior surface of the base panel faces upwardly when the collapsible display unit is operating as a bin in the assembled display configuration.

6. The collapsible display unit of claim 1, wherein an interior surface of the base panel faces downwardly or faces horizontally when the collapsible display unit is operating as a riser in the assembled display configuration.

7. A collapsible display unit comprising:

a high density, rigid sheet material comprising:

opposing widthwise sidewalls each having a centrally located living hinge that extends from a first free edge to a second free edge and a protruding tab that protrudes from the second free edge;

a base panel having a living hinge that extends lengthwise from a first free edge of the base panel to a second free edge of the base panel and through a center of the base panel, a first slot located adjacent to but not intersecting the first free edge of the base panel and a second slot located adjacent to but not intersecting the second free edge of the base panel;

opposing lengthwise sidewalls that are directly connected lengthwise to the base panel and one of the lengthwise sidewalls including opposing end flaps, wherein the opposing end flaps are welded to portions of the opposing widthwise sidewalls that are directly connected to the other of the opposing lengthwise sidewalls, each of the opposing lengthwise sidewalls having a length that corresponds with a length of the base panel;

wherein each of the opposing widthwise sidewalls have a width that corresponds with a width of the base panel;

wherein in an assembled display configuration each protruding tab of the opposing widthwise sidewalls is inserted into one of the respective first and second slots of the base panel so that the second free edges of the opposing widthwise sidewalls are securely positioned directly adjacent the respective first and second free edges of the base panel; and wherein in a collapsed configuration the protruding tabs of the opposing widthwise sidewalls are free from the respective first and second slots of the base panel and the opposing widthwise sidewalls and the base panel are folded at the living hinges without detaching portions of the opposing widthwise sidewalls from the end flaps of the opposing lengthwise sidewall.

8. The collapsible display unit of claim 7, wherein the opposing lengthwise sidewalls are directly connected to the base panel by opposing lengthwise bend lines.

9. The collapsible display unit of claim 7, wherein the opposing widthwise sidewalls are directly connected to one of the lengthwise sidewalls by opposing bend lines.

10. The collapsible display unit of claim 7, wherein an interior surface of the base panel faces upwardly when the collapsible display unit is operating as a bin.

11. The collapsible display unit of claim 7, wherein an interior surface of the base panel faces downwardly or faces horizontally when the collapsible display unit is operating as a riser.

12. A collapsible display unit comprising: a high density, rigid sheet material comprising: a base panel that is foldable along a living hinge that extends lengthwise from a first free edge of the base panel to a second free edge of the base panel and through a center of the base panel, the base panel including a first slot located adjacent to but not intersecting with the first free edge and centered on the living hinge and a second slot located adjacent to but not intersecting with the second free edge and centered on the living hinge; a first widthwise sidewall including a first tab protruding from a first free edge of the first widthwise sidewall that is securely located in a the first slot in the base panel in an assembled configuration and that is removable from the first slot in the base panel and foldable along a living hinge that extends through a center of the first widthwise sidewall from the first free edge of the first widthwise sidewall to a second free edge of the first widthwise sidewall in a collapsed configuration, wherein the first widthwise sidewall has a width that corresponds with a width of the first free edge of the base panel; a second widthwise sidewall including a second tab protruding from a first free edge of the second widthwise sidewall that is securely located in a the second slot in the base panel in an assembled configuration and that is removable from the second slot in the base panel and foldable along a living hinge that extends through a center of the second widthwise sidewall from the first free edge of the second widthwise sidewall to a second free edge of the second widthwise sidewall in the collapsed configuration, wherein the second widthwise sidewall has a width that corresponds with a width of the second free edge of the base panel; and first and second lengthwise sidewalls that are directly connected lengthwise to the base panel on opposing sides from each other, the first lengthwise sidewall having opposing end flaps that remain welded to portions of the opposing widthwise sidewalls for configuration between the assembled and collapsed configurations, each of the first and second lengthwise sidewalls having a length that corresponds with a length of the base panel; and wherein in the assembled configuration the display unit is oriented as a riser to support merchandise on an exterior surface of the first or second lengthwise sidewalls or on an exterior surface of the base panel.

13. The collapsible display unit of claim 12, wherein the first tab of the first widthwise sidewall is removable from the first slot in the base panel by pulling the first widthwise sidewall up from the base panel.

14. The collapsible display unit of claim 12, wherein the second tab of the second widthwise sidewall is removable form the second slot in the base panel by pulling the second widthwise sidewall up from the base panel.

15. The collapsible display unit of claim 12, wherein in the assembled configuration the interior surface of the base panel faces upwardly when the display unit is operating as the bin.

16. The collapsible display unit of claim 12, wherein in the assembled configuration the interior surface of the base panel faces downwardly or faces horizontally when the display unit is operating as the riser.

17. The collapsible display unit of claim 1, wherein the first lengthwise panel and the second lengthwise panel are configured to each fold flat against an inside of one of two portions of the base panel defined by the living hinge of the base panel such that a thickest portion of the collapsed display unit includes the first and second lengthwise side panels and the two portions of the base panel all folded flat against each other.

18. The collapsible display unit of claim 12, wherein the first and second lengthwise panels are configured to each fold flat against an inside of one of the two portions of the base panel defined by the living hinge of the base panel such that a thickest portion of the collapsed display unit includes the first and second lengthwise side panels and the two portions of the base panel all folded flat against each other.

* * * * *